United States Patent [19]

Bacher

[11] 3,996,534

[45] Dec. 7, 1976

[54] COAXIAL MICROWAVE TERMINATION HAVING ROD-SHAPED RESISTIVE TERMINATION

[75] Inventor: Helmut Bacher, Point Pleasant, N.J.

[73] Assignee: Midwest Microwave, Inc., Ann Arbor, Mich.

[22] Filed: June 30, 1975

[21] Appl. No.: 592,086

[52] U.S. Cl. ..... 333/22 R; 333/97 R

[51] Int. Cl.[2] ..... H01P 1/26

[58] Field of Search ..... 333/22 R, 22 F, 81 A; 338/216

[56] References Cited

UNITED STATES PATENTS

| | | | |
|---|---|---|---|
| 2,434,560 | 1/1948 | Gunter | 333/22 F |
| 2,498,335 | 2/1950 | Hunt | 333/22 R X |
| 3,209,284 | 9/1965 | Hast | 333/22 R X |
| 3,739,305 | 6/1973 | Engelmann | 333/81 A |

FOREIGN PATENTS OR APPLICATIONS

| | | | |
|---|---|---|---|
| 714,977 | 12/1941 | Germany | 338/216 |

*Primary Examiner*—Paul L. Gensler
*Attorney, Agent, or Firm*—Harness, Dickey & Pierce

[57] ABSTRACT

A microwave termination for dissipating substantially all of the energy transmitted through a coaxial line structure which has a body adapted to be connected to the outer conductor of the coaxial line, a center conductor adapted to be connected to the inner conductor of the coaxial line, a dielectric member disposed between the center conductor and the body for maintaining the center conductor coaxially disposed relative to the body, and a cylindrically shaped resistor radially disposed within the body so as to be in electrical contact with the body at its opposite ends and with the center conductor at a central portion thereof. The resistor has a resistive coating which absorbs the energy received by the termination from the coaxial line.

8 Claims, 4 Drawing Figures

COAXIAL MICROWAVE TERMINATION HAVING ROD-SHAPED RESISTIVE TERMINATION

BACKGROUND AND SUMMARY OF THE INVENTION

The present invention provides a microwave termination for microwave transmission line structures such as coaxial lines and the like. Prior art microwave terminations generally comprise a body serving as the ground or outer conductor and forming a cavity closed at one end, a center conductor, a dielectric bead which supports the center conductor in coaxial relationship with the body, and a resistive element within the cavity connected between the center conductor and the body. The resistive bodies of the prior art microwave terminations are found to have various configurations, for example, cylindrical and truncated cone configurations. Generally, these are symmetrically disposed about the same axis as the center conductor.

The present invention provides a novel microwave termination which has good microwave characteristics such as low voltage-standing-wave-ratio (VSWR) over a wide range of frequencies, e.g., D.C. to 18 GHz. Importantly, the termination of the present invention may be manufactured to relatively small dimensions and comprises component parts which are readily machined, or otherwise produced, and assembled.

The microwave termination of the present invention features a resistive rod or elongated cylindrical resistive element which is disposed within the cavity formed by the outer conductor and extends transversely of the axis of the center conductor, and preferably, extends perpendicularly of the axis of the center conductor, e.g., in spoke-like relationship therewith. For example, the resistive rod is electrically connected to the outer conductor or body at its opposite end portions and is electrically connected to the center conductor at a portion intermediate its ends. The intermediate portion is centrally located so as to provide a symmetrical structure. The resistive element may be a ceramic rod having a resistive layer such as a pyrolytic carbon coating of predetermined ohms per square. The microwave energy entering the termination from the coaxial line is substantially entirely dissipated in this resistive element.

Other features and advantages of the present invention will be apparent in view of the following detailed description of the preferred embodiment.

DETAILED DESCRIPTION OF THE PREFERRED EMBODIMENT

Figure 1:
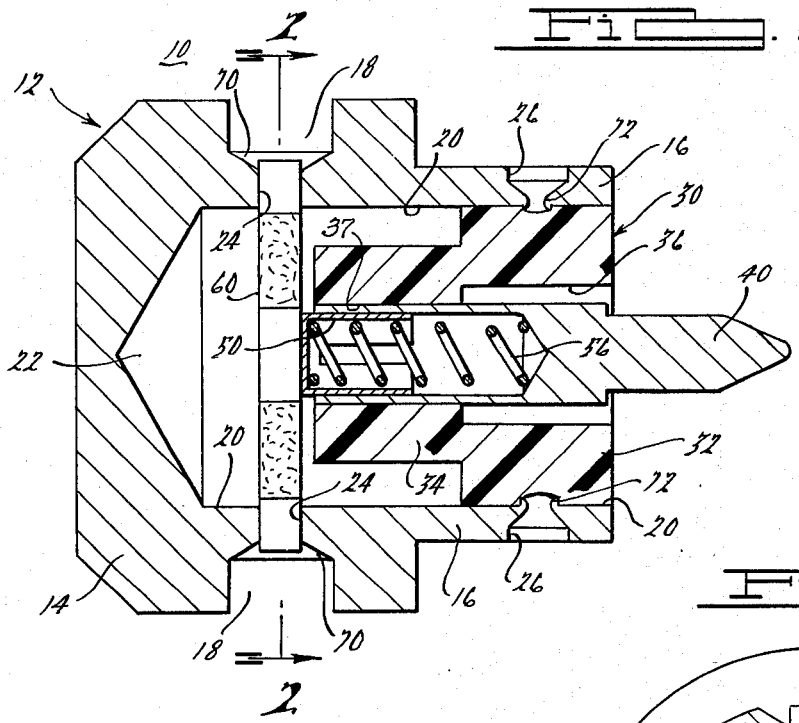
FIG. 1 is a cross-sectional view of a microwave termination embodying the present invention taken along the axis of the termination.

Referring to FIG. 1, a microwave termination 10 of small dimensions embodying the present invention is shown. The termination is adapted to absorb virtually all of the microwave energy in the line by means of the resistive member of the termination, thereby minimizing the reflection of microwave energy to the line. The particular termination illustrated in the Figures and to be described in detail is a ½ watt 50 ohm miniature termination for connection to a coaxial line structure. As an exemplary preferred embodiment, the particular materials used, and the exact dimensions of the various parts and their tolerances will be given. However, the description is not to be considered as limiting the scope of the present invention, but rather as merely providing a particular preferred working embodiment thereof. Moreover, the present invention can be adapted for use with other transmission line structures than coaxial lines.

The termination 10 shown comprises a male body 12 which connects to the outer conductor of the external coaxial line. The body 12 is made of stainless steel and consists of two integral parts, each having a circular cross-section to provide cylindrical external portions. The large end portion 14 has a diameter of 0.250 in. and the axially aligned sleeve portion 16 has a diameter of 0.1795 in. The overall length of the body 12 is 0.275 in. with the sleeve portion 16 comprising 0.094 in. of that length. The larger portion 14 has a solid end surface with a chamfered outer peripheral edge. Additionally, a circumferential groove 18 is formed in the larger portion 16 to a depth slightly larger than the diameter of the sleeve 16. More specifically, the resulting diameter of the grooved surface is 0.196 in. The rectangular shaped groove 18 is 0.051 in. wide and 0.134 in. from the sleeve end of the body 12.

Starting from the sleeve end of the body 12, a center bore 20 0.1450 in. in diameter is drilled into the body 12 to a depth of 0.217 in. The bore 12 then tapers to a point 22 in conical fashion without extending through the sealed end of the body 12 so as to form a cavity.

Centered within the groove 18 is a small radial hole 24 0.022 in. in diameter, drilled completely through both sides of the body 12. Axially aligned with the "exit" points of this radial hole 24 are two additional holes 26 0.0313 in. in diameter, located on the sleeve portion 16 of the body, 0.035 in. from the end. The two holes 26 are radially aligned and are drilled to a depth of from 0.001–0.002 inches of breakthrough into the center bore. The purpose for this will be explained later.

Fitted within the center bore 20 of the male body 12 is a dielectric support bead 30 made of Noryl plastic which is available from General Electric Co. The dielectric bead 30 serves to support the center conductor 40 (to be subsequently described) so that the proper distance is maintained between the outer diameter of the center conductor 40 and the inner diameter of the male body 12. This insures a substantially constant characteristic impedance between the external coaxial cable and the subject termination, thus avoiding an impedance mismatch. The bead 30 consists of two integral portions; a larger section 32 having a diameter of 0.1465 in. and a smaller section 34 having a diameter of 0.104 in. The length of the larger section 32 is 0.071 in., and the overall length of the bead 30 is 0.160 in. The larger section 32 has a center bore 36 of 0.068 in. in diameter drilled to a depth of 0.071 in., and the smaller section 34 has a center bore 37 of 0.048 in. in diameter drilled into the larger bore 36.

Figure 3:
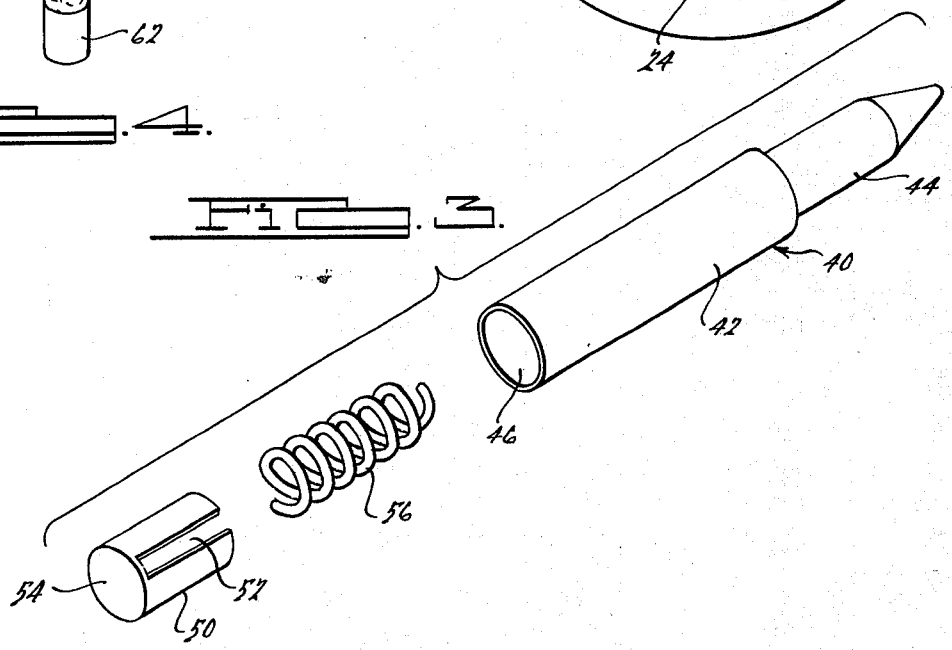
FIG. 3 is an exploded view of the center conductor and plunger assembly of the termination illustrated in FIG. 1.

The center bore 36 through the dielectric bead is adapted to receive a "plunger-pin" assembly shown in exploded fashion in FIG. 3. Note that the center conductor is retained at the bore 37 of the dielectric support bead 30, for example, by a press fit. The larger bore 36 provides a gap between the center conductor and the support bead 30 which minimizes the length of the press fit for ease of assembly and which provides an appropriate compensation for the standard "SMA" connector which uses a Teflon support bead which extends fully from the center conductor to the outer conductor. The Noryl material has a higher dielectric constant than Teflon, so compensation is obtained by the lesser amount of Noryl material between the center and outer conductors at the "SMA" connector junction. The "pin" or center conductor 40 is made of gold plated beryllium copper and is adapted to be connected to the inner conductor of the external coaxial cable. The center conductor 40 comprises two axially aligned sections; a cylindrical portion 42 0.157 in. long and 0.050 in. in diameter, and a pin section 44 0.090 in. long and 0.036 in. in diameter. The full diameter of the pin 44 extends only 0.055 in. from the cylindrical portion 42, and thereafter tapers to a rounded point as shown. The cylindrical section 42 also has a center bore 46 0.042 in. in diameter drilled to a depth of 0.100 in. The center bore 46 is intended to receive the plunger-spring assembly shown in FIG. 3. The spring 56 consists of 0.007 in. diameter music wire with a cadmium plating. In its relaxed state, the spring 56 is 0.140 in. long and 0.035 in. in diameter, and has square ends and six active coils. Springs of this type are commercially available from the Spring Engineering Co., Detroit, Michigan. The plunger or contact 50 is made of beryllium copper and is designed to fit over one end of the spring 56, and then together with the spring 56, into the bore 46 of the center conductor 40 so that the sealed end 54 of the plunger 50 faces in the opposite direction of the pin 44. The tubular-shaped plunger 50 has an outer diameter of 0.041 in., an inner diameter of 0.037 in., and a length of 0.140 in. Additionally, two radially opposed slots 52 are formed in the walls, parallel to the axis of the plunger 50, to a point just short of its sealed end 54. This gives the walls of the plunger 50 flexibility, providing a good sliding contact with the bore 46 of the center conductor 40.

Figure 4:
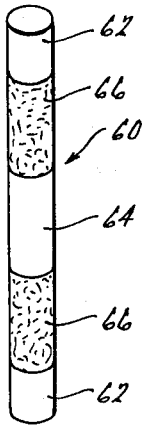
FIG. 4 is an illustration of the cylindrical resistive member of the termination.

The resistive member 60 of the termination 10, best illustrated in FIG. 4, consists of a solid rod of aluminum oxide 0.030 in. in diameter and 0.187 in. in length. The resistor 60 has its end sections 62 and its mid-section 64 gold plated to provide optimum electrical contact with the male body 12 and the sealed end 54 of the plunger 50, respectively. The gold plating extends 0.023 in. from the ends of the resistor 60 and comprises a 0.050 in. band around the center. This leaves a distance of 0.140 in. between the end coatings 62 and defines two uncoated bands 66 0.045 inches each in length. The resistor 60 is "fired" to a value of 100–130 ohms/square, with a pyrolytic carbon coating on the surface of the resistor 60 as shown. It will be appreciated that other suitable resistive coatings may be used.

Figure 2:
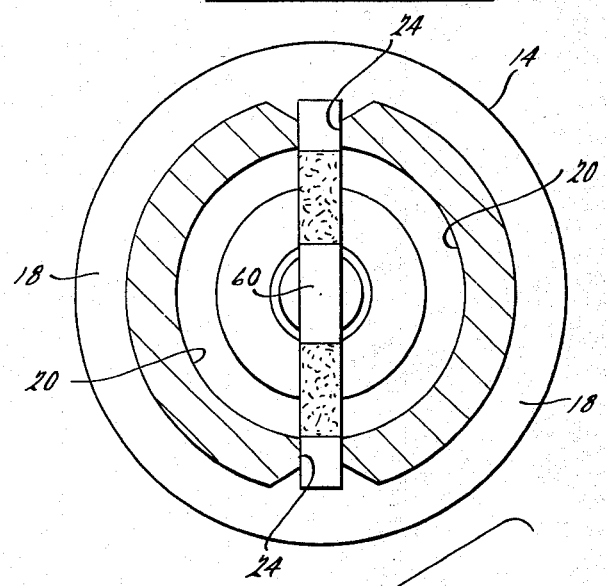
FIG. 2 is a cross-sectional view of the microwave termination shown in FIG. 1 taken along section line 2—2.

The entire microwave termination 10 is assembled as follows: the resistor 60 is inserted in the radial hole 24 located in the circumferential groove 18 of the male body 12, as shown in FIGS. 1 and 2. The resistor 60 is positioned by centering the gold-plated band 64 in the body 12. The dielectric bead 30, containing the subassembly of FIG. 3, is then inserted in the center bore 20 of the body 12, as shown, such that the large diameter end 32 of the bead is flush with the front face of the body 12. Note that because the cylindrical end 42 of the center conductor 40 is flush with the inside facing of the bead 30, the pin 44 is set in 0.002–0.005 in. from the front face of the body 12. The sealed end 54 of the plunger 50 is thereby brought into spring contact with the gold-plated band 64 of resistor 60. Thus, there is electrical connection between the pin 44 and resistor 60. To secure the dielectric bead in place, the two holes 26 located in the sleeve portion 16 of the body are "staked" - i.e., punched through — as shown at 72, so that the burrs from the undrilled portion of the holes 26 will embed themselves into the plastic dielectric bead 30. By utilizing this method of fastening, the characteristic impedance of the termination remains virtually constant, thereby avoiding possible reflections of energy.

With the resistor 60 now held in place by the spring tension of the plunger 50, the groove 18 over the ends of the resistor 60 is carefully covered with a conductive epoxy as shown at 70. The AC-2 conductive epoxy manufactured by Kenics Corporation has been found to be suitable for this purpose.

In operation, the male body 12 is electrically connected to the outer conductor of an external coaxial cable and the center conductor 40 electrically connected to the inner conductor. Upon application of microwave power to the termination 10, virtually 100% of the energy running between the conductors in the coaxial line is absorbed in the carbon layer 66 of the resistive element 60. With the energy thus dissipated, reflections in the line are minimized.

It will be appreciated by those skilled in the art that the preferred embodiment of the invention disclosed herein is susceptible to modification, variation and change without departing from the proper scope or fair meaning of the subjoined claims.

I claim:

1. A termination adapted to be connected to a coaxial transmission line having an inner conductor and a coaxially disposed outer conductor to receive energy therefrom in the microwave range for dissipating substantially all of the energy received from the coaxial line, comprising:

an electrically conductive body adapted to be connected to the outer conductor of said transmission line having a bore partially extending along a predetermined axis of said body and having an end wall and a cylindrical side wall defining a closed cavity, said conductive body further having a transverse bore in said cylindrical side wall extending substantially perpendicularly of said predetermined axis into said cavity at a location axially spaced from said end wall of said closed cavity;

a dielectric member having a portion adapted to mate with said bore of said body and having a bore extending along said predetermined axis;

a center conductor adapted to be connected to the inner conductor of said transmission line having a portion adapted to mate with the bore of said dielectric member so that said center conductor is coaxially disposed within said partial bore along said predetermined axis, said center conductor being positioned relative to said partial bore of said body so that said center conductor terminates at an end which extends into said cavity but is spaced from said end wall of said bore; and a dielectric rod-like member extending substantially perpendicular of said predetermined axis into said closed cavity of said body, said dielectric member having a resistive layer thereon, said dielectric member being disposed in said transverse bore and having said resistive layer thereon in electrical contact with said body at said transverse bore, said dielectric member extending adjacent to said center conductor and having said resistive layer in electrical contact with said center conductor at said end thereof.

2. The termination of claim 1 wherein said dielectric member is a cylindrical member.

3. The termination of claim 1 wherein said resistive layer comprises carbon.

4. The termination of claim 1 wherein said dielectric member further comprises a highly conductive coating on said portion thereof disposed in said end bore to electrically connect said resistive layer to said body and a highly conductive coating on the portion thereof adjacent to said end of said center conductor to electrically connect said resistive layer to said center conductor.

5. The termination of claim 4 wherein said conductive coating is metallic.

6. The termination of claim 1 wherein said dielectric member is a member comprising Noryl.

7. The termination of claim 1 wherein said dielectric member has a pair of ends with the resistive layer at both ends electrically connected to said body.

8. The termination of claim 7 wherein said resistive layer has a central portion intermediate its ends electrically connected to said center conductor.

* * * * *